US005688225A

United States Patent [19]

Walker

[11] Patent Number: 5,688,225

[45] Date of Patent: Nov. 18, 1997

[54] THERAPEUTIC FOOTWEAR

[76] Inventor: John W. Walker, 1088 Hilton Sound Dr., Chapin, S.C. 29036

[21] Appl. No.: 509,051

[22] Filed: Jul. 31, 1995

[51] Int. Cl.[6] ..... A61H 7/00

[52] U.S. Cl. ..... 601/11; 601/151; 128/882

[58] Field of Search ..... 601/6–11, 148, 601/151, 152; 602/5, 13, 16; 128/DIG. 20, 882

[56] References Cited

U.S. PATENT DOCUMENTS

| | | | |
|---|---|---|---|
| 59,388 | 11/1866 | Hadfield . | |
| 1,399,095 | 12/1921 | Webb, Sr. | 601/11 X |
| 1,629,108 | 5/1927 | Lake | 601/151 X |
| 3,286,711 | 11/1966 | MacLeod | 601/11 |
| 3,862,629 | 1/1975 | Rotta | 128/DIG. 20 X |
| 4,738,249 | 4/1988 | Linman et al. | 601/152 |
| 4,805,601 | 2/1989 | Eischen, Sr. | 601/151 |
| 5,000,164 | 3/1991 | Cooper | 601/11 |
| 5,435,009 | 7/1995 | Schild et al. | 128/DIG. 20 X |

FOREIGN PATENT DOCUMENTS

| | | | |
|---|---|---|---|
| 2737734 | 12/1978 | Germany | 601/151 |
| 3605621 | 8/1987 | Germany | 601/151 |
| 1491509 | 7/1989 | U.S.S.R. | 601/11 |

*Primary Examiner*—Danton D. DeMille
*Attorney, Agent, or Firm*—Ralph Bailey

[57] ABSTRACT

A therapeutic device for maintaining a substantially uniform partial vacuum about a lower extremity of a wearer suffering from poor circulation in the feet includes a lower member (A) defining a boot for containing the foot of the wearer and being attached to an upper member (B). The boot is sealed at the top for maintaining the partial vacuum in the space between the boot and the wearer by a suitable sealing member (C) while a connection (D) is provided for receiving a vacuum pump for producing a partial vacuum within the boot preferably of about 1–2 psi below atmospheric pressure. A mold for custom making boots includes a mold core (E) constructed essentially of plaster about which plastic is injection molded followed by breaking away of the plaster.

10 Claims, 5 Drawing Sheets

Fig. 3-A

THERAPEUTIC FOOTWEAR

BACKGROUND OF THE INVENTION

This invention relates to a therapeutic boot for applying and maintaining uniform partial vacuum to the foot and lower leg of a wearer, such as a diabetic, having inadequate blood circulation to the feet.

The prior art is best illustrated in U.S. Pat. No. 5,000,164 which discloses apparatus producing pulses synchronized with the patient's heartbeat creating a vacuum over-pressure cycle promoting blood circulation to an injured limb for treating frostbite and the like. The problems inherent in synchronizing the pulses to a patient's heartbeat are difficult to overcome and this problem is especially acute if the patient's heartbeat is irregular. Moreover, the foot of the patient is immobilized by the boot and attachments thereto so as to inhibit walking while the boot is applied to the foot of the patient. The various attachments include pressure modulators, transducers and other control circuitry which act as impediments to the patient's ability to walk while wearing the boot. The prior art is further illustrated by U.S. Pat. No. 1,399,095 which discloses a relatively rigid chamber shaped to generally conform to a body part to which a partial uniform vacuum is applied with heat generated by electrical coils embedded in the rigid plastic structure forming the chamber.

Other patents illustrate deformable footwear for increasing fluid pressure applied to the lower extremity. These include U.S. Pat. Nos. 3,824,992, 3,888,242 and 4,805,601 which relate to boots for applying increased pressures to the lower extremity of patients having injured areas to which varying fluid pressures are applied.

SUMMARY OF THE INVENTION

Accordingly, it is an important object of the present invention to provide a chamber in the form of a boot which can be used for walking by applying and maintaining a relatively uniform controlled, steady, continuous partial vacuum to the lower extremity of a user such as a diabetic who requires treatment calculated to produce enhanced blood flow to the feet.

Another important object of the invention is the provision of a boot inexpensively constructed of plastic such as polypropylene which may be manufactured by injected molding, transfer molding and the like.

Another important object of the invention is the provision of a tubular sealing member adjacent the top of the boot for creating a zone therebeneath in a space between the lower extremity and the boot. Preferably this seal includes an accordion or corrugated support member for positioning a tubular gasket seal and the like. In lieu of the tube a flexible gasket member may be provided which flares inwardly and upwardly over the extremity with sealing characteristics which may be enhanced by the application of denture cream between the gasket and the wearer. Provision is made for providing a lower hinge running medially longitudinally along the bottom of the boot together with upwardly extending zip-lock fastening means and the like in the walls of the boot facilitating insertion of the foot in the boot, which is thereby completely parted down the middle for ease of placement of the extremity. The hinge is preferably formed by a grooved portion of the molded plastic of the sole.

Another important object of the invention is the provision of a suitable attachment device such as a nipple for securement of a manually operated vacuum pump for partially exhausting the space within the boot surrounding the lower extremity. A gauge may also be supplied for indicating the amount of partial vacuum or negative pressure obtaining within the boot.

Thus, an important object of the invention is to provide a mechanical device to increase blood circulation in medical patients' feet, particularly those suffering from diabetes. The device includes a pair of shoes or boots which are placed on the feet and lower legs of the patient, sealed, and partially evacuated to result in a low pressure environment which is believed to best be in the range of 1–3 psi below atmospheric pressure. This results in one's feet acting like a tank which is constantly evacuated while fluid is being pumped in, which gives an increase in flow without an increase in inlet pressure.

Boots constructed in accordance with the invention change the environment in the area of the feet, reducing resistance to blood flow to the feet and thus increasing the flow. How much the environmental pressure is decreased determines how much the flow is increased. The flow increase to the feet must be a small increase since the blood flow to the rest of the body must have a relatively small decrease.

The major method of manufacture of the boot is by modified injection molding, described in greater detail below and is believed to be the best method for making the boot. Since a mold would be required for each size or type of boot, and since boots would have to be custom made for the patient, conventional injection molding may be impractical.

A standard plastic mold may be made by pouring the plaster over wooden patterns. Two patterns are required for the boots. Customarily the cast product is removed by breaking away the plaster. However, since melted polymer cannot be poured, the plaster mold is encased in a heavy chamber in which it can be injection molded over once. The plaster is then broken away.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3A is a transverse sectional elevation taken on the line 3A—3A in FIG. 3;

DESCRIPTION OF A PREFERRED EMBODIMENT

The drawings illustrate a therapeutic device for receiving a lower human extremity of a wearer having poor blood circulation in the feet. A lower member A forms a substantially air tight receptacle for a foot of the wearer. An upper member B extends above an ankle of the wearer and is connected to the lower member in substantially air tight relation thereto. The upper and lower members have sufficient flexibility to permit the wearer to walk with the device in position with the extremity received thereon. A sealing member C is carried adjacent an open top of the upper member for forming a substantially air tight zone between said upper member and the lower human extremity when received in the therapeutic device without exerting excessive localized pressure against the limb. A vacuum pump connection D is carried by the therapeutic device communicating with a space between the therapeutic device and the lower human extremity below the sealing member. The lower member and the upper member include walls having sufficient rigidity to withstand the force of a substantially uniform partial vacuum in said space sufficient to adequately increase blood circulation in the space without excessive deformation. Thus, a reduced pressure is applied and maintained about a portion of the lower human extremity within the therapeutic device to increase the flow of blood thereto.

Boots constructed in accordance with the invention are custom made to fit each customer and this is preferably done by an injected molding process wherein polypropylene is injected about a plaster mold core E which is carried within a metallic mold.

Figure 2:
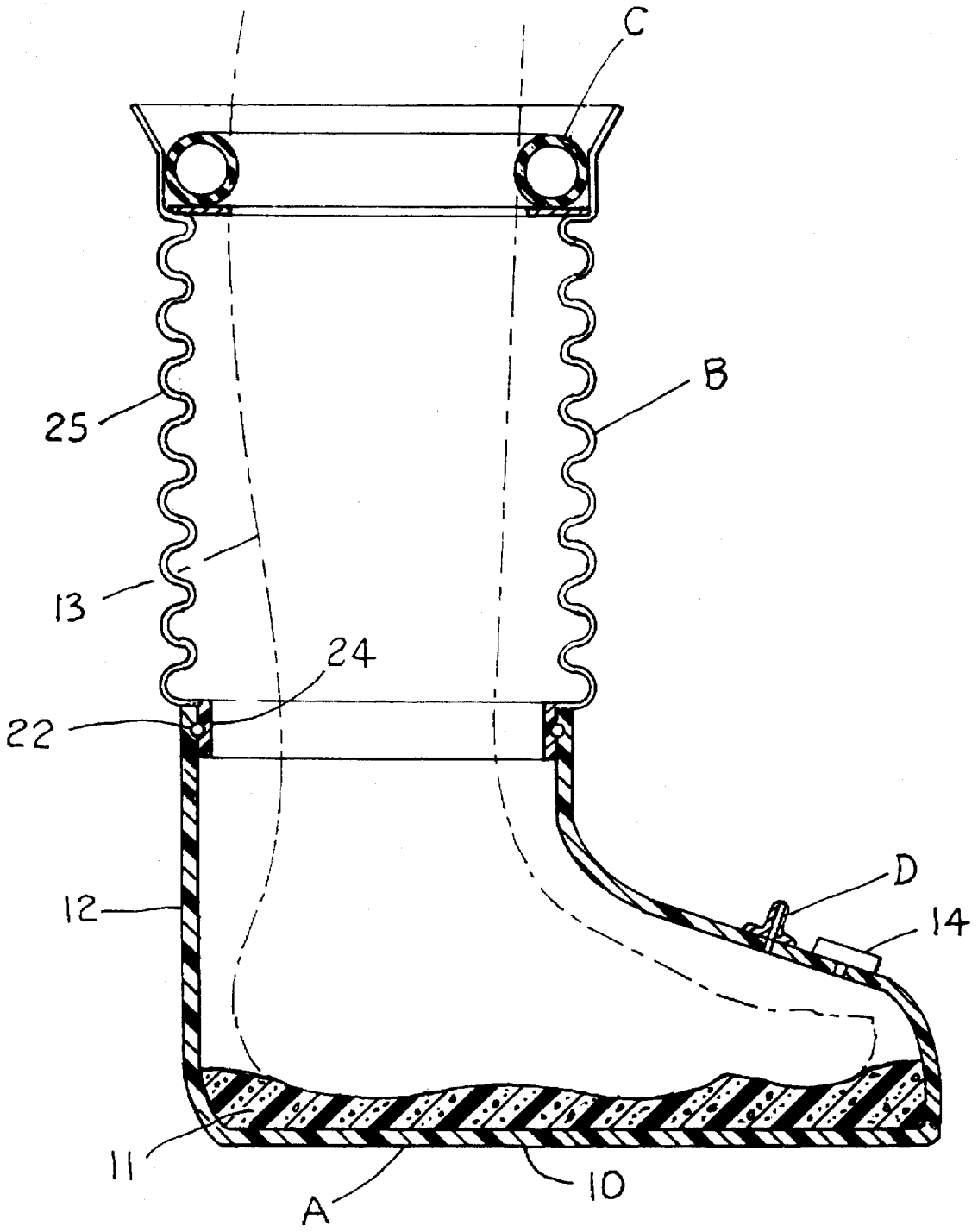
FIG. 2 is a side elevation further illustrating the boot of FIG. 1 with the lower limb of the user positioned within the boot for treatment and for walking.
Figure 3:
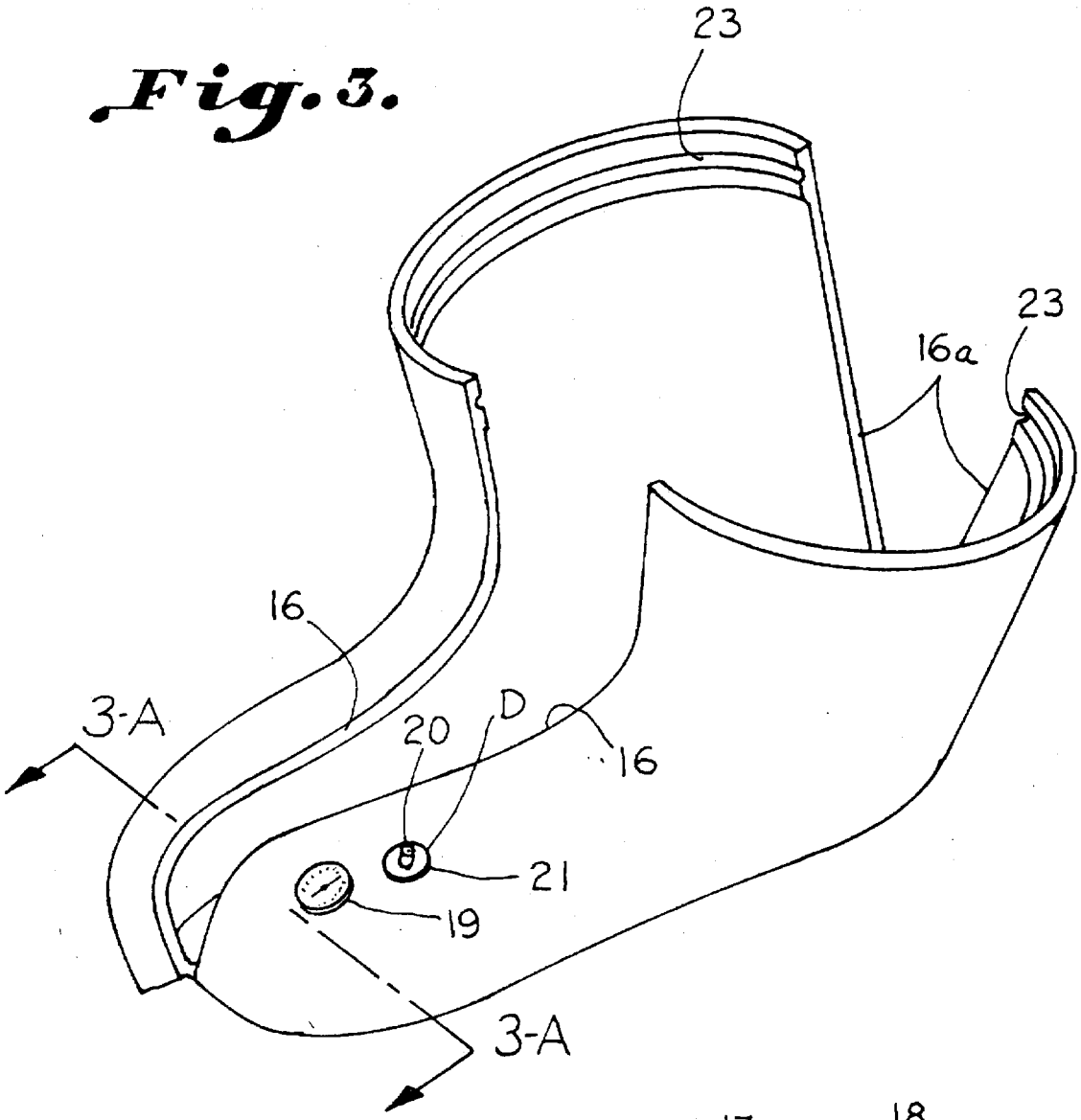
FIG. 3 is a perspective view illustrating the boot in open position about a lower longitudinal medially disposed hinge carried in the sole together with closure means for joining the halves, which are folded back on the hinge for placement of the foot of the patient in the open boot.
Figure 3:
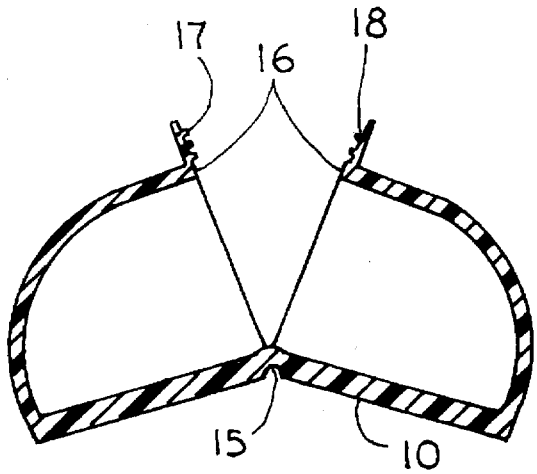

The boot is preferably constructed of polypropylene by a modified injection molding process in accordance with the invention. The lower member A is illustrated in FIG. 2 as including a sole 10 carrying a suitable cushion 11. The lower member has an upwardly extending wall 12 attached to the sole above the ankle of the lower extremity 13 of the wearer. The lower member A carries a pressure gauge 14 communicating with the interior thereof and has a hinge 15 extending medially from front to rear of the sole of lower member. The hinge formed by the groove which is molded into the lower member to facilitate opening of the boot as illustrated in FIGS. 3 and 3-A. The boot includes a medial parting line illustrated at 16. The parting line 16 is illustrated in FIG. 3-A as carrying zip-lock members 17 and 18 in a front wall of the boot and in the rear wall of the boot. The zip-lock members are omitted in FIG. 3 for purposes of clarity of illustration. A pressure gauge 19 is secured to the lower part of boot as is a vacuum coupling D which includes a nipple 20 secured by a base 21 to communicate with the interior of the boot. An upper member B is illustrated for extending above the ankle of the wearer in FIGS. 1, 2, 4 and 5. The upper member is suitably connected to the lower member as by means of an O-ring 22 in FIG. 2. A groove 23 is illustrated in FIG. 3 for containing the O-ring 22 (FIG. 2) which is fastened after the upper member B is first placed about the lower extremity and adjusted vertically so as to secure the member C to maintain connection about the top of the boot. The lower member A is secured by positioning the O-ring in the groove and against the stiffener 24 about the inside top portion of member A for attachment of the lower and upper members of the boot in sealing relation. Preferably the upper member has an accordion or bellows-like portion 25 at the top to provide some flexibility to the relatively rigid plastic upper walls of the boot.

Figure 1:
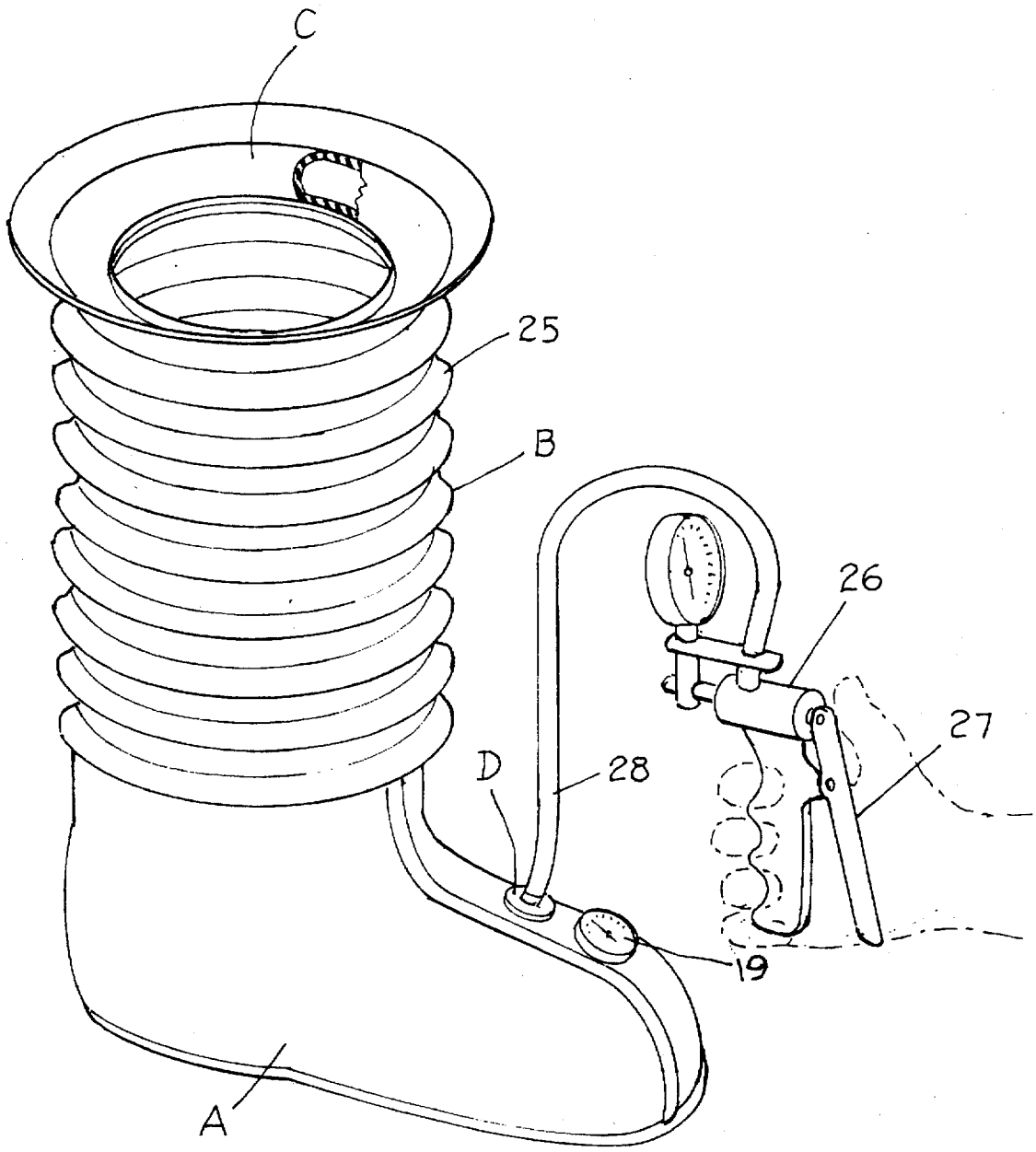
FIG. 1 is a perspective view illustrating a boot having attachment means for a vacuum pump as well as a vacuum gauge and with securement for means for positioning the boot around a lower extremity of the user.

FIG. 1 illustrates a hand-operated vacuum pump such as provided by Neward Enterprises Incorporated of Cucamonga, Calif. under the trademark MITYVAC. The vacuum pump is illustrated as including a pump 26 operated manually by a movable handle 27 to induce a vacuum in the line 28 which is connected to interior of the boot through the connection D.

Figure 4:
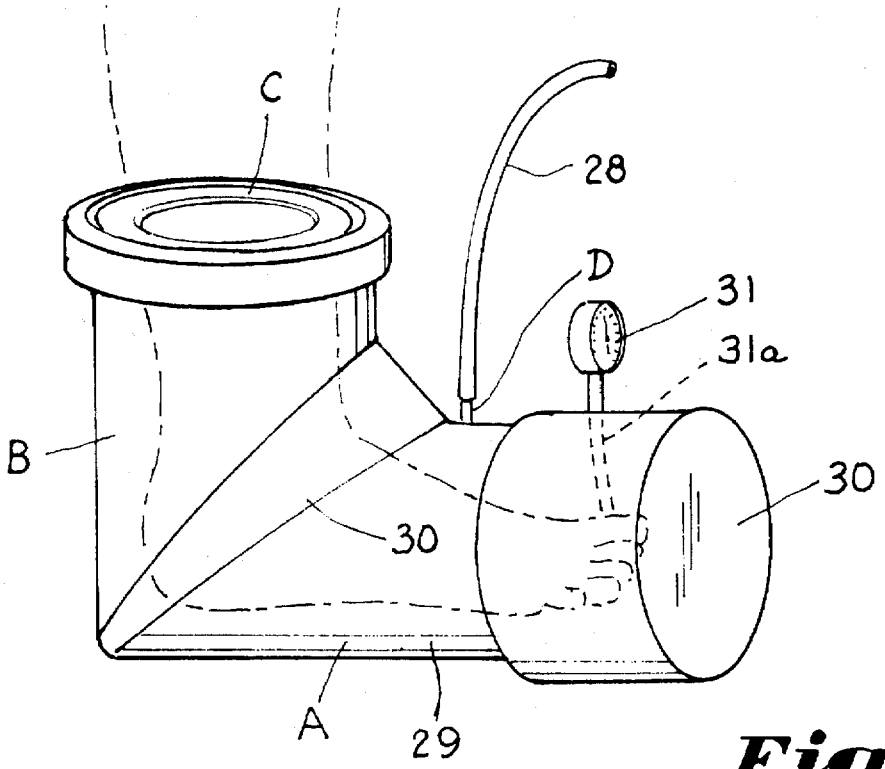
FIG. 4 is a side elevation illustrating a modified form of the invention wherein a chamber is provided for maintaining a partial vacuum about a lower extremity which is generally conformable to the lower extremity of the user but which is inflexible so as to inhibit walking. These and other vacuum chambers may be utilized for treating the lower extremities of a patient who is bedridden.

A modified form of the invention is shown in FIG. 4 which illustrates a lower member A constructed from a section of PVC pipe including a horizontal section 29. The upper member B is integrally connected to the lower member A by an intermediate member 30. A suitable sealing member C is provided in the upper end of the upper member B. A thermometer 31 has a suitable probe 31*a* for making temperature measurements as utilized in the examples given below.

Figure 5:
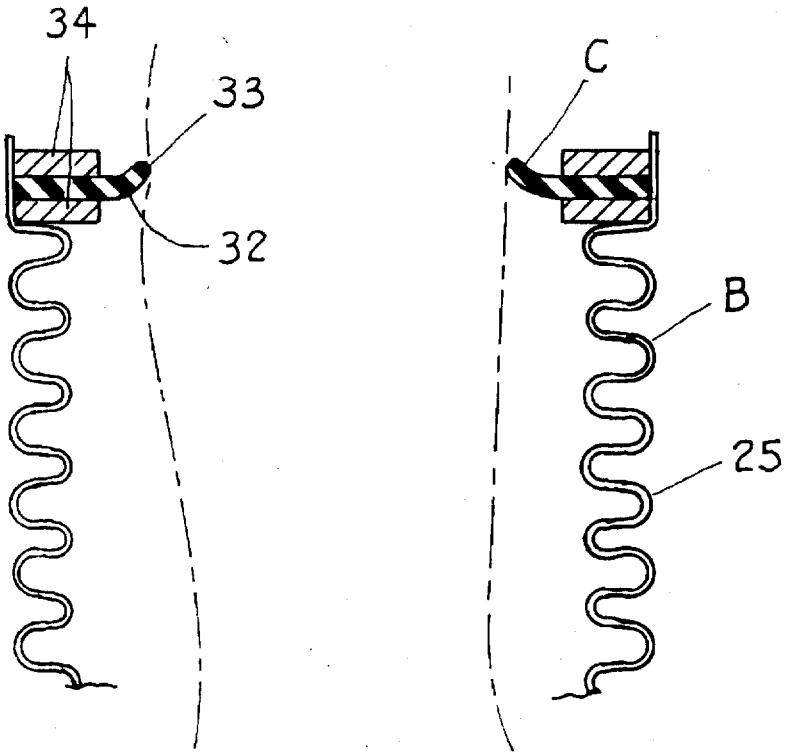
FIG. 5 is a sectional elevation illustrating a flexible lip constructed in accordance with the invention for being disposed in an upward position for sealing a top of the boot and maintaining a desired partial vacuum.

FIG. 5 illustrates a further modified form of the invention wherein a sealing member C is provided in the form of a flexible lip 32 in the form of a diaphragm having an internal opening 33 which is slightly smaller than the diameter of the lower extremity. The diaphragm is suitably carried between brackets 34 and adjacent an upper end of the upper member B. If necessary, a suitable sealant such as denture cream could be utilized to secure a seal between the lip and the limb of the wearer.

Figure 6:
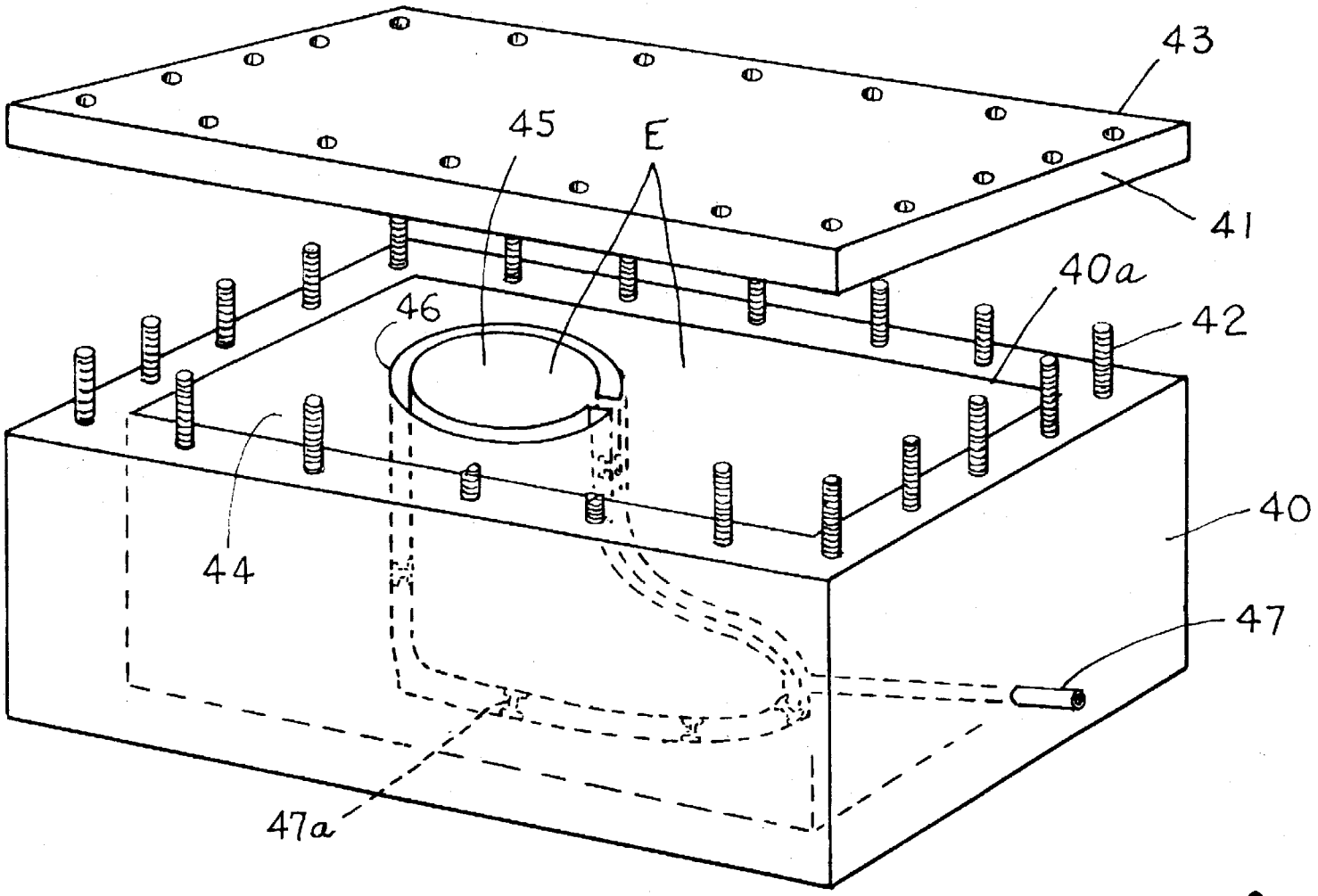
FIG. 6 is a perspective view illustrating a mold and method for constructing a plastic boot in accordance with the invention.

FIG. 6 illustrates a metallic mold having a base member 40 defining a cavity therein. The base 40 receives the lid 41 and is positively positioned by threaded members 42 extending upwardly from the base to be received in openings 43 in the lid. The mold core E is essentially constructed of an outer plastic member 44 containing an inner core member 45 formed by pouring plaster over a wooden core mold. The inner form member 45 is suitably supported within the recess 46 as by spaced supports 47*a* and plastic is injected through the connection 47 about the mold core for custom making a boot as governed by the configuration of the lower limb of the wearer.

Preferably a substantially uniform vacuum in a range of about 1–2 psi below atmospheric is believed to be adequate, although it may be desirable to produce a greater degree of vacuum up to about 5 psi below atmospheric pressure. The boot may be kept in place as long as about 3 days, although it is desirable to purge the boot with air after that time. Preferably, treatment is carried out with an ambulatory patient, although the device may be utilized with bedridden patients or those who need treatment over a period of time as desired.

FIG. 4 illustrates the apparatus described in the experiments constituting the examples set forth below and it is thought that similar structures may advantageously be utilized with bedridden patients as where walking may not be required at all times.

The invention is illustrated by the following examples.

EXAMPLE NO. 1

Vacuum Chamber—6" diameter PVC Pipe

Vacuum Pump Cole-Parmer 7930-20 Hand Vacuum Pump

Temp. Gages Omega HL—40+0+160° F. bi-metallic

Patient's Left Foot

Encased in boot apparatus similar to that shown in FIG. 4.

Thermometer readings starting at same temperature agreed within 1° F. Both feet bare and on floor.

| | Vacuum | Temperatures | |
|---|---|---|---|
| Time | Pressure | Left Foot | Right Foot |
| 10:06 | 0 | 67° F. | 68° F. |
| 10:15 | 100 mm (2.1 psi below atmospheric) | 68° F. | 68° F. |
| 10:20 | 100 | 70° F. | 68° F. |
| 10:30 | 100 | 71° F. | 67° F. |
| 10:47 | 100 | 72° F. | 66° F. |
| 10:50 | 100 | 73° F. | 66° F. |
| 10:55 | 100 | 74° F. | 66° F. |
| 11:05 | 100 | 74° F. | 66° F. |
| 11:15 | 100 | 76° F. | 66° F. |
| 11:20 | 100 | 78° F. | 66° F. |
| 11:25 | 100 | 78° F. | 64° F. |
| 11:30 | 100 | 79° F. | 64° F. |

The pressure was held at 2.1 psi, which would be the equivalent of raising one's feet 4.8 feet. While raising one's feet lowers the hydrostatic pressure, such does not substantially lower atmospheric pressure. The vacuum of 2.1 psi actually caused the temperature (thus the blood circulation) to perhaps increase too rapidly because of swelling and reddening. Foot elevation is a regular hospital procedure to increase blood circulation in one's feet.

Thus, lowering the atmospheric pressure on one's feet by using the vacuum boots does increase the circulation. The medical method to see if blood flow changes utilizes temperature measurements.

At half the pressure, the pressure/temperature relation should be about the same as a square root relation. The temperature rise measured at 2.1 psi was 8° F. per hour. At ½ the pressure it should be in the range of 2° F. per hour.

EXAMPLE NO. 2

1. Measure diabetic patient's left and right foot surface temperature by firm contact with the Omega dial thermometer probe and with the Cole Parmer Temperature Tester.

(a) At bedtime when feet are cold, record results.

(b) At wake-up time, record results.

Procedure: Hold probe firmly between big toe and next toe in every test.

2. After getting up, sit in a chair, have breakfast and take usual medication. Measure left and right foot temperatures. As in step 1, this takes about 1–1½ hours.

3. Apply experimental device to left foot, measure and record temperatures as in step 1.

Switch temperature devices and measure and record as in step 1.

5. With Cole Parmer Temperature Tester on the test apparatus foot and the Omega probe on the right foot, start vacuum testing at negative 1 psi. Measure and record temperature and time. Continue until equilibrium is reached.

6. Reduce pressure in ½ psi negative steps and record temperature and time until equilibrium is reached. Continue until 2.5 psi and evaluate whether to test further.

| | Left Foot | Right Foot | Oral |
|---|---|---|---|
| NIGHTTIME COLD TEMPERATURE | | | |
| OMEGA 1 | 72 | 72 | 97 |
| OMEGA 2 | | | |
| COLE PALMER | 73 | 73 | 95 |
| ORAL | | | 96.2 |
| MORNING WARM TEMPERATURE | | | |
| OMEGA 1 | 80 | 80 | 98 |
| OMEGA 2 | | | |
| COLE PALMER | 80 | 80 | 94 |
| ORAL | | | 96.7 |
| EQUIPMENT OF FIG. 5 | | | |
| Apply Experimental Device - Atmospheric Pressure | | | |
| OMEGA | 72 | 69 | 96 |
| COLE PALMER | | | |
| OMEGA | 72 | 69 | |
| COLE PALMER | | | |
| ORAL | | | 96.8 |
| Apply Experimental Device - 1.0 psi below atmospheric | | | |
| COLE PALMER | | | 6 cm |
| OMEGA | 74 | 69 | 6 cm (1.15) psi |
| ORAL | | | |

TIME - PRESSURE - TEMPERATURE

| Time Minutes | Left Foot | Right Foot | cm/hg | psi |
|---|---|---|---|---|
| 0 | 72 | 69 | 6 | 1.15 |
| 5 | 74 | 68 | 6 | 1.15 |
| 7 | 75 | 68 | 10 | 1.917 |
| 8 | 75 | 68 | 15 | 2.876 |
| 10 | 76 | 68 | 20 | 3.836 |
| 17 | 77 | 68 | 20 | 3.836 |
| 20 | 78 | 68 | 20 | 3.836 |
| 23 | 78 | 68 | 20 | 3.836 |
| 30 | 80 | 68 | 12 | 2.30 |
| 34 | 81 | 67 | 8 | 1.534 |
| 38 | 81 | 67 | 12 | 2.301 |
| 42 | 82* (84°) | 67 | 12 | 2.301 |

SKIN TEMPERATURES VS. ORAL

| | | | |
|---|---|---|---|
| AT ELBOW | 93.4° F. | ORAL | 96.9 |
| PALM | 94.0 F. | ORAL | 97.6 |

*OMEGA Bi-metallic value checked with COLE PALMER Digital - Temperature Tester 84° F.

The conclusion may thus be made that a controlled vacuum at relatively low pressure will increase the blood circulation in one's feet.

The material for the production boot is preferably polypropylene, and can be fabricated by an injection molding process or by a significantly cheaper transfer molding process.

When blood flow is low or inadequate, the patient's lower extremity gets cold. Doctors do not have an instrument to measure the flow externally. However, if the skin temperature responds to treatment and shows significant increase, the blood flow has increased. The data repeatedly shows a marked increase in foot skin temperature when subjected to modest decrease in the ambient pressure by subjecting a patient's foot to a reduced pressure in a simulated test using a plastic tube that is sealed to the patient's feet, evacuated with a hand operated vacuum pump, and the vacuum maintained for short periods of time. The data verifies that the blood flow in the left foot of the patient markedly increased, verified by the marked increase of the foot temperature.

Thus, the boot can be put on and adjusted by the patient and can, in most cases, permit a bedridden patient to walk. The boot can be worn indefinitely but should be purged on occasion with fresh air, or, if the patient desires, can be removed at night since the feet are elevated while resting.

While a preferred embodiment of the invention has been described using specific terms, such description is for illustrative purposes only, and it is to be understood that changes and variations may be made without departing from the spirit or scope of the following claims.

What is claimed is:

1. A therapeutic device for receiving a lower human extremity of a wearer having poor blood circulation in the feet comprising:

a lower member for receiving a foot of the wearer;

the lower member has a substantially imperforate sole providing support for the foot when walking;

an upper member for extending above an ankle of the wearer and connected to said lower member in substantially air tight relation thereto;

said upper and lower members forming a substantially air tight receptacle with walls having sufficient flexibility to permit the wearer to walk while wearing the device about said extremity while maintaining a substantially constant partial vacuum;

a sealing member carried adjacent an open top of said upper member for forming a substantially air tight zone between said upper member and said lower human extremity when received in said therapeutic device;

a connection carried by said therapeutic device for attaching a vacuum pump communicating with a space between said therapeutic device and said lower human extremity below said sealing member;

walls comprising said lower member and said upper member having sufficient rigidity to withstand the force of a substantially uniform partial vacuum in said space sufficient to adequately increase blood circulation in said foot without excessive deformation while permitting the wearer to walk; and whereby a pump and said walls apply and maintain a reduced pressure about a portion of said lower human extremity within said therapeutic device to increase the flow of blood thereto maintaining said extremity subjected to a substantially uniform partial vacuum in said receptacle for a period of time to achieve increased blood flow and a sufficiently elevated temperature in said extremity to effect a prescribed treatment.

2. The structure set forth in claim 1 wherein said sealing member is a tubular ring.

3. The structure set forth in claim 1 wherein said sealing member is a flexible diaphragm having a central opening to accommodate a patient's lower extremity.

4. The structure set forth in claim 1 wherein said lower member is molded polymer, and including a hinge in a sole running from front to rear of the device permitting the device to be spread open facilitating reception of the foot.

5. The structure set forth in claim 4 wherein a parting line extends upwardly from said hinge and is closable by an air tight zipper.

6. The structure set forth in claim 1 wherein said upper and lower members are separable and being joinable and sealable by means of an O-ring.

7. The structure set forth in claim 1 wherein said upper member is constructed from molded polymer, and including circumferential corrugations in said upper member permitting flexibility therein.

8. The structure set forth in claim 1 wherein said upper and lower members are integrally joined.

9. The structure set forth in claim 1 wherein said vacuum is from about 1 to about 5 psi below atmospheric pressure.

10. A therapeutic device for receiving a lower human extremity of a wearer having poor blood circulation in the feet comprising:

a substantially air tight receptacle for receiving a foot of the wearer and extending above an ankle having sufficient flexibility to permit the wearer to walk while wearing the device about said extremity;

the receptacle is substantially imperforate providing support for the foot when wearing and walking, including an imporforate sole for maintaining a substantially constant partial vacuum;

a sealing member carried adjacent an open top of said receptacle for forming a substantially air tight zone between said receptacle and said lower human extremity when received in said therapeutic device;

a connection carried by said therapeutic device for attaching a vacuum pump communicating with a space between said therapeutic device and said lower human extremity below said sealing member; and walls comprising said receptacle having sufficient rigidity to withstand the force of a substantially uniform partial vacuum in said space sufficient to adequately increase blood circulation in said foot without excessive deformation while permitting the wearer to walk; and whereby a pump and said walls apply and maintain a reduced pressure about a portion of said lower human extremity within said therapeutic device to increase the flow of blood thereto maintaining said extremity subjected to a substantially uniform partial vacuum in said receptacle for a period of time to achieve increased blood flow and a sufficiently elevated temperature in said extremity to effect a prescribed treatment.

* * * * *